United States Patent [19]

Clevenger et al.

[11] Patent Number: 4,767,260

[45] Date of Patent: Aug. 30, 1988

[54] STATOR VANE PLATFORM COOLING MEANS

[75] Inventors: Douglas H. Clevenger; Donald L. Deptowicz, both of Palm Beach Gardens, Fla.

[73] Assignee: United Technologies Corporation, Hartford, Conn.

[21] Appl. No.: 928,236

[22] Filed: Nov. 7, 1986

[51] Int. Cl.[4] ..... F01D 9/04

[52] U.S. Cl. ..... 415/115; 415/139; 415/191

[58] Field of Search ..... 415/115–117, 415/136, 138, 139, 134, 170 R, 189, 191, 180, 216, 217

[56] References Cited

U.S. PATENT DOCUMENTS

| | | | |
|---|---|---|---|
| 2,488,867 | 11/1949 | Judson | 415/136 |
| 2,651,496 | 10/1953 | Buckland et al. | 415/135 |
| 2,787,440 | 4/1957 | Thompson, Jr. | 415/12 |
| 2,847,185 | 8/1958 | Petrie et al. | 415/115 |
| 2,859,934 | 11/1958 | Halford et al. | 415/115 |
| 2,977,090 | 3/1961 | McCarty et al. | 416/96 R |
| 3,365,172 | 1/1968 | McDonough et al. | 415/117 |
| 3,391,904 | 7/1968 | Albert et al. | 415/170 R |
| 3,411,794 | 11/1968 | Allen | 277/53 |
| 3,575,528 | 4/1971 | Beam, Jr. et al. | 416/34 |
| 3,583,824 | 6/1971 | Smuland et al. | 415/117 |
| 3,588,276 | 6/1971 | Jubb | 416/95 |
| 3,603,599 | 10/1971 | Laird | 277/53 |
| 3,706,508 | 12/1972 | Moskowitz et al. | 415/115 |
| 3,736,069 | 5/1973 | Beam, Jr. et al. | 415/115 |
| 3,742,705 | 7/1973 | Sifford | 60/39.66 |
| 3,814,313 | 6/1974 | Beam, Jr. et al. | 236/93 |
| 3,836,279 | 10/1974 | Lee | 415/116 |
| 3,965,066 | 6/1976 | Sterman et al. | 60/39.32 |
| 3,966,356 | 6/1976 | Irwin | 415/217 |
| 4,023,919 | 5/1977 | Patterson | 415/134 |
| 4,127,357 | 11/1978 | Patterson | 415/116 |
| 4,337,016 | 6/1982 | Chaplin | 415/116 |
| 4,524,980 | 6/1985 | Lillibridge et al. | 415/191 X |
| 4,650,394 | 3/1987 | Weidner | 415/115 |

FOREIGN PATENT DOCUMENTS

| | | |
|---|---|---|
| 1330893 | 9/1973 | United Kingdom . |
| 1484288 | 9/1977 | United Kingdom . |
| 1600722 | 10/1981 | United Kingdom . |
| 2081817 | 2/1984 | United Kingdom . |
| 2117843 | 11/1985 | United Kingdom . |

*Primary Examiner*—Robert E. Garrett
*Assistant Examiner*—Joseph M. Pitko
*Attorney, Agent, or Firm*—Norman Friedland

[57] ABSTRACT

Judiciously dimensioned slots in feather seals between adjacent edges of platforms of segmented stator vane for a gas turbine power plant serves to allow the flow of cooling air through the slots notwithstanding the feather seal shifting.

1 Claim, 1 Drawing Sheet

STATOR VANE PLATFORM COOLING MEANS

The invention was made under a Government Contract and the Government has rights therein.

CROSS REFERENCE TO RELATED APPLICATIONS

This patent application relates to U.S. patent application Ser. No. 671,278 filed Nov. 13, 1984, now U.S. Pat. No. 4,650,394 for Coolable Seal Assembly for a Gas Turbine Engine by Robert H. Weidner and assigned to the same assignee as this patent application.

TECHNICAL FIELD

This invention relates to turbine airfoil platforms for a gas turbine engine and particularly to coolable seal means between adjacent platform segments of a stator vane construction.

BACKGROUND ART

As is well known the turbine receiving the gas turbine engine's fluid working medium (gas path) is exposed to an extremely hot environment. There is an ongoing attempt in industry to improve the efficiency and performance of the gas turbine engine, which invariably increases the operating temperatures of the engine. To this end much effort over recent years has been directed to turbine cooling technology which has seen significant advances. Of course, it is abundantly important to maintain temperatures of the exposed metals to within tolerable limits. This invention is concerned with the platforms of the stator vanes in the turbine section and particularly to cooling the abutting edges of the platforms of the adjacent segments in the stator of the turbine. The platform is exposed to the gas path on one surface and to cooling air on the other surface. The cooling air is supplied thereto from the engine's compressor and serves to cool the engine's components.

One of the problems that has been persistent is that the edges of adjacent platform in each of the segments of the stator sees a large temperature difference on opposing surfaces. For benefits in performance it is also necessary to maintain minimum leakage of the cooling air between the edges of adjacent vane segments. These large thermals impose severe thermal stresses resulting in a durability problem of the vane. Typically feather seals are disposed between adjacent platforms. The platforms are formed integrally at the tips and roots of each vane, and the vanes are formed into segments defining the annular shaped stator. Each adjacent side edge of adjacent platforms in the segments are slotted to receive a feather seal. To avoid interference with the feather seal which is generally a flat, rectangular shaped, thin sheet metal member, the slots are oversized in both the axial and tangential directions. The opposing side edges of the feather seal fit into the opposing slots in adjacent segments and due to the oversize is capable of moving.

While there have been attempts to purge the side edges that are exposed to the gas temperature path temperature, such attempts were inadequate. The feather seal, for example would be perforated to allow coolant air to exist between the platform surfaces, but the oversized slot and consequential movement of the feather seal disrupted the flow of coolant and permitted the edges of the platform to overheat and owing to the high thermals durability problems would be evidenced.

We have found that by shaping the slots in such a manner so as to preclude the disturbance of the volume of cooling air passing therethrough regardless of the relative position of the feather seal the durability problem alluded to above will be eliminated or minimized.

DISCLOSURE OF INVENTION

It is an object of this invention to provide judiciously sized and shaped cooling slots in the feather seals of stator vane platforms that will provide constant volume of cooling air regardless of its relative position in the platform slots.

A feature of this invention is to provide improve cooling means of platform surfaces of a turbine stator vane of a gas turbine engine without compromising performance and cost and by utilizing existing hardware.

Other features and advantages will be apparent from the specification and claims and from the accompanying drawings which illustrate an embodiment of the invention.

BEST MODE FOR CARRYING OUT THE INVENTION

Figure 1:
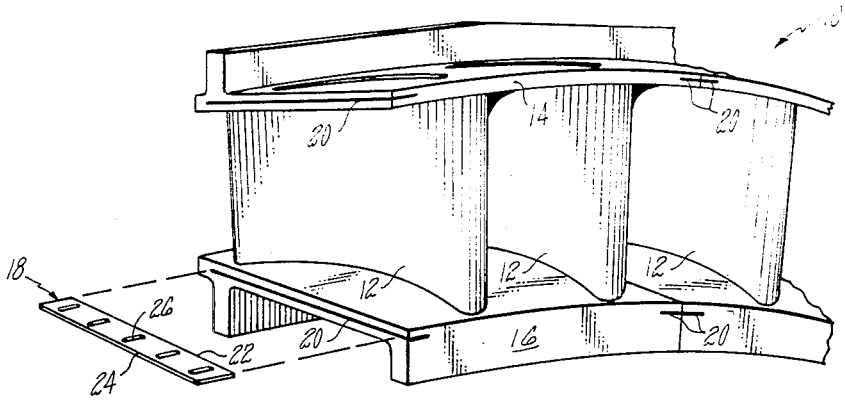
FIG. 1 is a partial view in perspective of a pair of segments of a stator vane assembly and partially exploded to show the feather seal in relation to the side slot.
Figure 2:
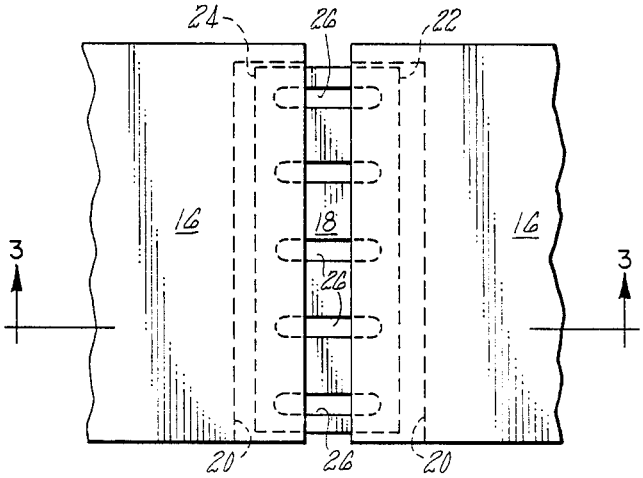
FIG. 2 is a partial view showing adjacent slots of the platform and the feather seal.
Figure 3:
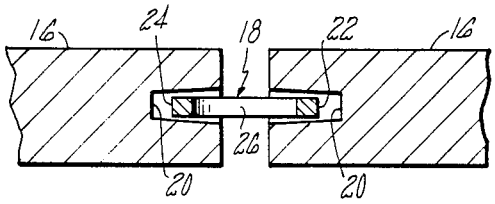
FIG. 3 is an end view of FIG. 2.

In its preferred embodiment the invention is best understood by referring to FIGS. 1, 2 and 3 which partially show a pair of segments generally noted by reference numeral 10 of the stator vane assembly for a gas turbine engine. Each segment of the stator-vane assembly may comprise two or more circumferentially spaced air foiled shaped vanes 12 sandwiched between the outer platform 14 and inner platform 16. The segments are stacked circumferentially to define an annular flow path. The gas path flows through the vane assembly between vanes and is bounded on the outer surface and inner surface by the upper platform 14 and lower platform 16, respectively. For the sake of simplicity and convenience the details of the construction of the vanes and components have been omitted, but for further details reference is made to any of the vane assemblies disclosed in the F100, JT9D, JT8D, engines manufactured by Pratt & Whitney, a division of United Technologies Corporation, the assignee of this patent application.

As noted, machine grooves are formed in the side edge of adjacent platforms to define complimentyary slots 20 for receiving the feather seal 18. These slots are oversized relative to the feather seal 18 in both the axial and tangential directions. The feather seal is fabricated from sheet metal and formed in a relatively thin, rectangularly shaped member. The opposing sides 22 and 24 of feather seal 18 fit into the opposing slots 20 and form a barrier between the gas path and the cooling air sides. Inasmuch as the slots are oversized the feather seal can move tangentially and axially.

In order to obviate the durability problem associated with surfaces exposed to the gas path, a controlled amount of coolant is allowed to pass through the feather seal to displace the hot gas path. This serves to improve the end wall durability without compromising performnce and cost.

As is apparent from the foregoing the movement of the feather seal changes the surface of the feather seal that is exposed to the flow path. In accordance with this invention judiciously located and discretely shaped slots 26 are formed in the feather seal 18 so that regardless of the relative movement of the feather seal 18 with respect to complementary slots 20 the total area for flowing cooling air is constant, so that there is always a positive coolant flow for all positions of the feather seal and for all engine operating conditions.

What has been shown by this invention is a relatively inexpensive way to improve the durability of the platform of a stator vane by utilizing existing hardware and without impairing performance.

It should be understood that the invention is not limited to the particular embodiments shown and described herein, but that various changes and modifications may be made without departing from the spirit and scope of this novel concept as defined by the following claims.

We claim:

1. For a gas turbine engine having a turbine section including a stator vane, said stator vane comprising a plurality of circumferentially abutting segments defining an annular flow path, at least two airfoil members having a tip and base circumferentially spaced in each of said segments, each segment having an upper platform member and a lower platform member defining with adjacent segments an annular flow path for directing the engine's fluid working medium through the turbine section, a cooling air cavity for receiving air at a lower temperature than the temperature of the fluid working medium, one surface of said upper platform and said lower platform being exposed to said fluid working medium and the other surface of said upper platform and said lower platform being exposed to said cooling air in said cavity, a feather seal having opposing sides fitted into complementary slots formed in the abutting side edges of platforms of adjacent segments, said feather seal being dimensioned smaller than said complementary slots so as to be in slidable relation with said slots, means for flowing cooling air at a constant volume from said cavity through said feather seal to said fluid working medium for every position of said feather seal.

* * * * *